US010926972B1

(12) United States Patent
Hegler et al.

(10) Patent No.: US 10,926,972 B1
(45) Date of Patent: Feb. 23, 2021

(54) MOBILE CRADLE FRAME FOR PIPE REEL

(71) Applicant: TRINITY BAY EQUIPMENT HOLDINGS, LLC, Houston, TX (US)

(72) Inventors: Matthew Hegler, Kingwood, TX (US); John Leger, Baytown, TX (US); Alexander Lee Winn, Spring, TX (US)

(73) Assignee: TRINITY BAY EQUIPMENT HOLDINGS, LLC, Houston, TX (US)

( * ) Notice: Subject to any disclaimer, the term of this patent is extended or adjusted under 35 U.S.C. 154(b) by 0 days.

(21) Appl. No.: 16/671,304

(22) Filed: Nov. 1, 2019

(51) Int. Cl.
*B65H 75/44* (2006.01)
*B65H 75/40* (2006.01)
*B65H 75/14* (2006.01)

(52) U.S. Cl.
CPC ..... *B65H 75/4457* (2013.01); *B65H 75/403* (2013.01); *B65H 75/4442* (2013.01); *B65H 75/14* (2013.01); *B65H 2402/343* (2013.01); *B65H 2701/33* (2013.01)

(58) Field of Classification Search
CPC ..... B65H 49/20; B65H 49/205; B65H 49/32; B65H 49/324; B65H 49/34; B65H 49/36; B65H 2701/33; B65H 2402/343; B65H 75/403; B65H 75/4442; B65H 75/4457; B65H 75/4465
See application file for complete search history.

(56) References Cited

U.S. PATENT DOCUMENTS 1,275,716 A 8/1918 Maurer
2,380,415 A 7/1945 Carruthers
2,613,084 A 10/1952 Burch
4,085,904 A * 4/1978 McElroy ..... B65H 49/34 242/564
4,655,670 A 4/1987 Hogberg et al.
4,692,082 A 9/1987 Smith
(Continued)

FOREIGN PATENT DOCUMENTS

CN 106629228 5/2017
DE 3440042 5/1986
(Continued)

OTHER PUBLICATIONS

ITOOLco; How to Lift and Feed Heavy Spools of Wire—iTOOLco Power Feeder; Jul. 25, 2014; 8 pages; https://www.youtube.com/watch?v=YN1B72bZrgs.
(Continued)

*Primary Examiner* — William E Dondero
(74) *Attorney, Agent, or Firm* — Greenberg Traurig, LLP; Dwayne L. Mason

(57) ABSTRACT

A cradle apparatus and method for transporting and/or deploying a coil of pipe supported around a reel are disclosed. The cradle apparatus can include a first arm member and a second arm member each having a male segment and a female segment capable of telescopic movement. A first set of pipe reel engagement spools and a second set of pipe reel engagement spools can rotate to raise/lift a first flange and a second flange of the reel thereonto when the pipe reel is positioned between the first arm member and the second arm member and the proximal end and the distal end of the first arm member and the second arm member are brought closer together due to telescopic movement of the male and female segments.

24 Claims, 10 Drawing Sheets

(56) References Cited

U.S. PATENT DOCUMENTS

| | | | | |
|---|---|---|---|---|
| 4,854,803 | A | 8/1989 | Coccaro | |
| 4,976,449 | A | 12/1990 | Lotspeich et al. | |
| 5,893,571 | A | 4/1999 | Nowell | |
| 6,347,761 | B1 * | 2/2002 | Larson | B65H 49/32 242/390.5 |
| 6,789,994 | B2 | 9/2004 | Tortellier | |
| 7,097,406 | B1 | 8/2006 | Gang | |
| 8,931,724 | B2 * | 1/2015 | Jordan | B65H 49/38 242/403 |
| 10,226,964 | B2 | 3/2019 | Rucchetto | |
| 10,273,111 | B2 | 4/2019 | Grabowski et al. | |
| 10,301,149 | B2 | 5/2019 | Franklin-Hensler et al. | |
| 2001/0038094 | A1 | 11/2001 | Lundy, Sr. et al. | |
| 2004/0146384 | A1 | 7/2004 | Whelan | |
| 2006/0045683 | A1 | 3/2006 | Huiming et al. | |
| 2007/0182115 | A1 | 8/2007 | Groomes | |
| 2014/0117634 | A1 | 5/2014 | Heinz | |
| 2018/0170706 | A1 * | 6/2018 | Grabowski | B65H 49/321 |
| 2018/0312185 | A1 | 11/2018 | Weitzel et al. | |
| 2019/0127176 | A1 * | 5/2019 | Franklin-Hensler | B65H 75/4481 |

FOREIGN PATENT DOCUMENTS

| | | |
|---|---|---|
| DE | 198432103 | 7/1988 |
| DE | 202017103759 | 8/2017 |
| FR | 2901225 | 11/2007 |
| FR | 2889109 | 11/2008 |
| JP | 2015117129 | 6/2015 |
| WO | 2009/056168 | 5/2009 |

OTHER PUBLICATIONS

Richmond Wheels and Castors; Ezi ParkR Hydraulic Vehicle Positioning Jack; Jan. 26, 2015; 3 pages; https://www.youtube.com/watch?v=its2Kh-HKi8.

discountramps.com; Black Widow Steel Hydraulic Jack & Wheel Dolly—1,500 lbs. Capacity; printed May 4, 2020; 4 pages; https://www.canbuilt.com/products.php?cat=42&subcat=118.

Canbuilt Manufacturing; GoJak® Model 6313™—Vehicles to 6,300 lbs; printed May 4, 2020; 5 pages; https://www.canbuilt.com/products.php?cat=42&subcat=118.

amazon.com; 1500 lbs Hydraulic Positioning Car Wheel Dolly Jack Lift hoists Moving Vehicle; printed May 4, 2020; 7 pages; https://www.amazon.com/Stark-Vehicle-Positioning-Hydraulic-Ratcheting/dp/B07QY2RSYH/ref=sr_1_fkmr0_2?dchild=1&keywords=SKEMIDEX+Moving+Dollies+Hydraulic+Positioning&qid=1588613800&sr=8-2-fkmr0.

U.S. Patent and Trademark Office; PCT International Search Report, issued in connection to application No. PCT/US20/058472; dated Dec. 19, 2020; 2 pages; U.S.

U.S. Patent and Trademark Office; PCT Written Opinion of the International Searching Authority, issued in connection to application No. PCT/US20/058472; dated Dec. 19, 2020; 8 pages; U.S.

* cited by examiner

MOBILE CRADLE FRAME FOR PIPE REEL

BACKGROUND

Flexible pipe is useful in a myriad of environments, including in the oil and gas industry. Flexible pipe may be durable and operational in harsh operating conditions and can accommodate high pressures and temperatures.

Flexible pipe may be bundled and arranged into one or more coils to facilitate transporting and using the pipe. The flexible pipe may be transported as coils to various sites for deployment (also referred to as uncoiling or unspooling).

Different types of devices and vehicles are currently used for loading and transporting coils of pipe, but usually additional equipment and human manual labor is also involved in the process of loading or unloading such coils for transportation and/or deployment. Such coils of pipe are often quite large and heavy, and difficult to transport.

Accordingly, there exists a need for an improved method and apparatus for transporting, and loading and unloading, coils of pipe.

SUMMARY

Various illustrative embodiments of a cradle apparatus for supporting a pipe reel are disclosed herein. In certain embodiments, the apparatus can include a first arm member and a second arm member each having a male segment and a female segment capable of telescopic movement. A first set of pipe reel engagement spools can be disposed at a proximal end and a distal end of the first arm member and can be capable of rotational movement with respect to the first arm member. A second set of pipe reel engagement spools can be disposed at a proximal end and a distal end of the second arm member and can be capable of rotational movement with respect to the second arm member. A connecting member can be coupled to the first arm member and the second arm member and extend therebetween. A ground engagement device can be coupled to one or more of the first arm member, the second arm member and the connecting member and capable of engaging a ground surface. The first set of pipe reel engagement spools and the second set of pipe reel engagement spools can be capable of contacting a first flange and a second flange, respectively, of the pipe reel and rotating to raise the first flange and the second flange thereonto when the pipe reel is positioned between the first arm member and the second arm member and the proximal end and the distal end of the first arm member and the second arm member are brought closer together due to telescopic movement of the male and female segments. Each pipe reel engagement spool can include a pair of retaining walls having a channel formed therebetween for engaging the flange of the pipe reel. The channel can be concave-shaped. An actuator can be connected to the male segment and the female segment of the first arm member to promote telescopic movement between the segments. An actuator can also be connected to the male segment and the female segment of the second arm member to promote telescopic movement between the segments. The actuator can also be disposed on only one of the first arm member and the second arm member to promote telescopic movement between the male and female segments of both the first arm member and the second arm member. The first arm member and the second arm member can be configured such that the telescopic movement of the male segment and the female segment of the first arm member, and of the male segment and the female segment of the second arm member, are not simultaneous. The ground engagement device can be one or more of a track and a plurality of roller wheels. The apparatus can further include a brake coupled to one or more of the first arm member and the second arm member and capable of engaging the flange of the pipe reel. The brake can include at least one of a brake pad or a caliper brake configured to engage a peripheral circumferential surface of the flange of the pipe reel. A pipe re-spooler can be coupled to one of the first arm member and the second arm member, wherein the pipe re-spooler can include a wheel with a flexible surface configured to rotationally engage at least one of the first and second ends of the pipe reel. A retention shaft can be configured to be inserted into a bore of the pipe reel, and a chain can have a first end coupled to the retention shaft and a second end coupled to the frame of the cradle apparatus, and the retention shaft and chain can be configured to maintain the pipe reel on the cradle apparatus.

Various illustrative embodiments of a method of supporting a pipe reel are also disclosed herein. In certain embodiments, the method can include one or more of the following steps. The pipe reel can be placed within a cradle apparatus. The cradle apparatus can include a first arm member and a second arm member, the arm members each having a male segment and a female segment capable of telescopic movement, a connecting member coupled to the first arm member and the second arm member and extending therebetween, a ground engagement device coupled to one or more of the first arm member, the second arm member and the connecting member and capable of engaging a ground surface, a first set of pipe reel engagement spools disposed at a proximal end and a distal end of the first arm member and capable of rotational movement with respect to the first arm member, and a second set of pipe reel engagement spools disposed at a proximal end and a distal end of the second arm member and capable of rotational movement with respect to the second arm member. Each pipe reel engagement spool can include a pair of retaining walls and a concave-shaped channel formed therebetween for engaging a flange of the pipe reel. The proximal end and the distal end of the first arm member can be moved closer together via telescopic movement of the respective male and female segments, such that the first set of pipe reel engagement spools contact a first flange of the pipe reel and rotational movement of the first set of pipe reel engagement spools causes the first flange to be raised by and sit upon the first set of pipe reel engagement spools. The proximal end and the distal end of the second arm member can be moved closer together via telescopic movement of the respective male and female segments, such that the second set of pipe reel engagement spools contact a second flange of the pipe reel and rotational movement of the second set of pipe reel engagement spools causes the second flange to be raised by and sit upon the second set of pipe reel engagement spools. Movement of the proximal end and the distal end of the first arm member closer together, and of the proximal end and the distal end of the second arm member closer together, can then be ceased. At this point, the pipe reel can be supported in a raised position. Each pipe reel engagement spool can include a pair of retaining walls having a channel formed therebetween for engaging the flange of the pipe reel. The channel can be concave-shaped. An actuator can be connected to the male segment and the female segment of the first arm member to promote telescopic movement between the segments. An actuator can also be connected to the male segment and the female segment of the second arm member to promote telescopic movement between the segments. An actuator can be disposed on only one of the first arm member and the second arm member to promote telescopic movement between the male and female segments of both the first arm member and the second arm member. The telescopic movement of the male segment and the female segment of the first arm member, and of the male segment and the female segment of the second arm member, can be staggered, or otherwise not simultaneous. The ground engagement device can be one or more of a track and a plurality of roller wheels. The apparatus can further include a brake coupled to one or more of the first arm member and the second arm member and capable of engaging one or more of the plurality of roller wheels. The brake can include at least one of a brake pad or a caliper brake configured to engage a peripheral circumferential surface of the flange of the pipe reel. A pipe re-spooler can include a wheel with a flexible surface configured to rotationally engage at least one of the first and second ends of the pipe reel, and the spoolable pipe can be removed from the pipe reel by at least one of pulling the spoolable pipe from the pipe reel when the pipe reel is stationary or moving the pipe reel away from a stationary end of spoolable pipe. A retention shaft can be configured to be inserted into a bore of the pipe reel and a chain can have a first end coupled to the retention shaft and a second end coupled to the frame of the cradle apparatus, and the retention shaft and chain can maintain the pipe reel on the cradle apparatus.

Other aspects and advantages of the claimed subject matter will be apparent from the following description and the appended claims.

DETAILED DESCRIPTION

Figure 1:
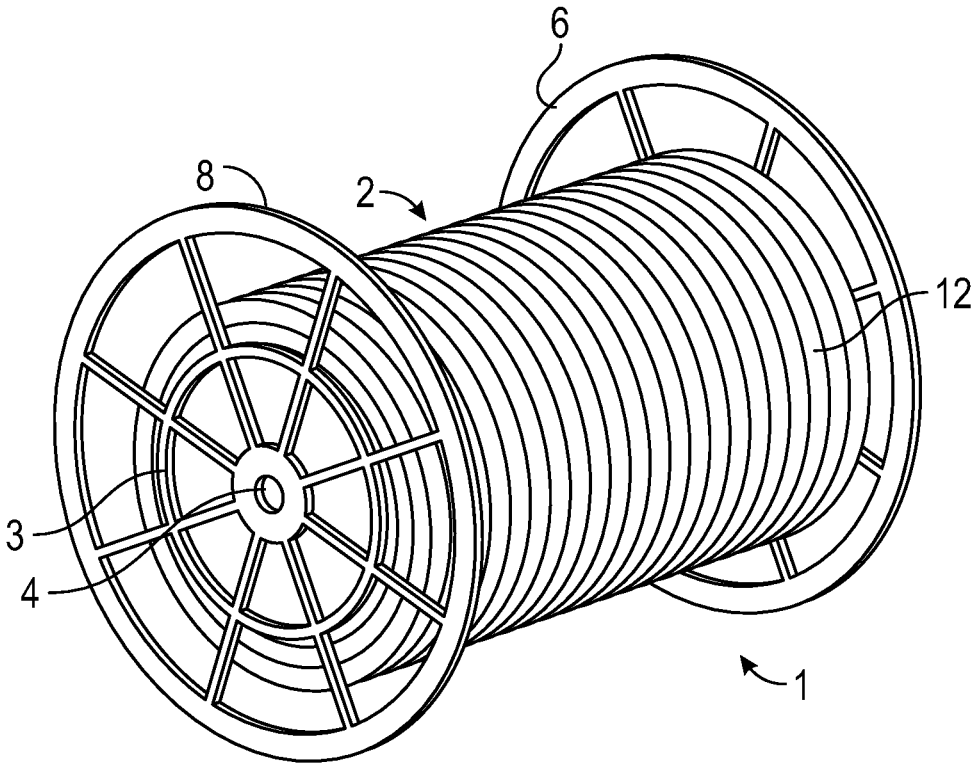
FIG. 1 is a perspective view of a reel of pipe and coil according to embodiments of the present disclosure.

The presently disclosed subject matter generally relates to a mobile apparatus for use in transporting and/or deploying a coil of pipe supported around a reel (which may be referred to as a reel of pipe).

Embodiments of the present disclosure will be described below with reference to the figures. As used herein, wherever possible like or identical reference numerals are used in the figures to identify common or the same elements. The figures are not necessarily to scale and certain features and certain views of the figures may be shown exaggerated in scale for purposes of clarification.

FIG. 1 illustrates an embodiment of a reel 1 of pipe. In many instances, a coil of pipe 2 may be wound around the components of reel 1. The coil of pipe 2 may be wound around reel 1 such that the interior channel of the coil of pipe 2 is concentric with a central bore of the reel 1. A reel, as understood by those of ordinary skill, may include a cylindrical drum, such as cylindrical drum 3, around which layers of pipe may be wrapped to form a coil of pipe, such as coil of pipe 2. Reel 1 may include two substantially circular reel ends 6 and 8 that are capable of turning about a shared axis. Accordingly, reel ends 6 and 8 may be attached to cylindrical drum 3.

As shown in FIG. 1, a bore 4 is disposed in each end 6 and 8 at a substantially central position. In addition, the bores 4 for each end 6 and 8 are substantially aligned with each other (and may also be aligned with a central axis of cylindrical drum 3). Pipe 12 (e.g., flexible pipe) may be wound around cylindrical drum 3 using any means known to those of ordinary skill in the art.

A pipe, as understood by those of ordinary skill, may be a tube to convey or transfer any water, gas, oil, or any type of fluid known to those skilled in the art. The pipe 12 used to make up coil of pipe 2 may be made of any type of materials including without limitation plastics, metals, a combination thereof, composites (e.g., fiber reinforced composites), or other materials known in the art.

In one or more embodiments, the pipe 12 used to make up coil of pipe 2 may be a flexible type of pipe or referred to as spoolable pipe. Flexible pipe is used frequently in many applications, including without limitation, both onshore and offshore oil and gas applications. Flexible pipe may include Bonded or Unbonded Flexible Pipe, Flexible Composite Pipe (FCP), Thermoplastic Composite Pipe (TCP), or Reinforced Thermoplastic Pipe (RTP). FCP or RTP pipe may itself be generally composed of several layers. In one or more embodiments, a flexible pipe may include a thermoplastic liner or internal pressure sheath having a reinforcement layer and a thermoplastic outer cover layer. In one or more embodiments, the thermoplastic may be high density polyethylene (HDPE). Thus, flexible pipe may include different layers that may be made of a variety of materials and also may provide corrosion resistance. For example, in one or more embodiments, pipe used to make up a coil of pipe may have a corrosion protection outer cover layer that is disposed over another layer of steel reinforcement. In this embodiment, helically wound steel strips may be placed over a liner made of thermoplastic pipe. Flexible pipe may be designed to handle a variety of pressures. Further, flexible pipe may offer unique features and benefits versus steel/carbon steel pipe lines in the area of corrosion resistance, flexibility, installation speed and reusability. Another type of flexible or spoolable pipe is coiled tubing, which may be made of steel and have corrosion protection shield layer.

Coils of pipe 2 may be made with coil having an outer diameter ranging, for example, from about 2 inches (5.1 cm) to about 10 inches (25.4 cm) or more. However, pipe having other dimensions may be coiled to form a coil of pipe 2 according to embodiments of the present disclosure. Accordingly, pipe that that may be spooled or coiled into coil of pipe 2 may be made to suit a number of dimensions and may have any diameter useful to a particular project.

As known to those of ordinary skill in the art, pipe 12 used to make up coil of pipe 2 may be coiled using spoolers or other coiler machines suited for such a function. Those of ordinary skill will recognize that the present disclosure is not limited to any particular form of coiler or other device that may be used to form pipe into a coil. Coiling pipe into a coil of pipe, such as 2, assists when transporting pipe, which may be several hundred feet in length in one or more embodiments. Further, coil of pipe 2 may be assembled as a coil to facilitate deployment of the coil. Deployment, as described above and used herein, may refer to the action of unspooling or unwinding the pipe 12 from coil of pipe 2.

FIGS. 2-9 show illustrative embodiments of a cradle apparatus 10 for supporting a reel 1 of pipe. In certain illustrative embodiments, apparatus 10 can include a first arm member 20 and a second arm member 30 each comprising a male segment 20*a*, 30*a* and a female segment 20*b*, 30*b* capable of telescopic movement. Apparatus 10 can also include a first set of pipe reel engagement spools 25*a*, 25*b* disposed at a proximal end and a distal end of the first arm member 20 and capable of rotational movement with respect to the first arm member 20, and a second set of pipe reel engagement spools 35*a*, 35*b* disposed at a proximal end and a distal end of the second arm member 30 and capable of rotational movement with respect to the second arm member 30.

Figure 2:
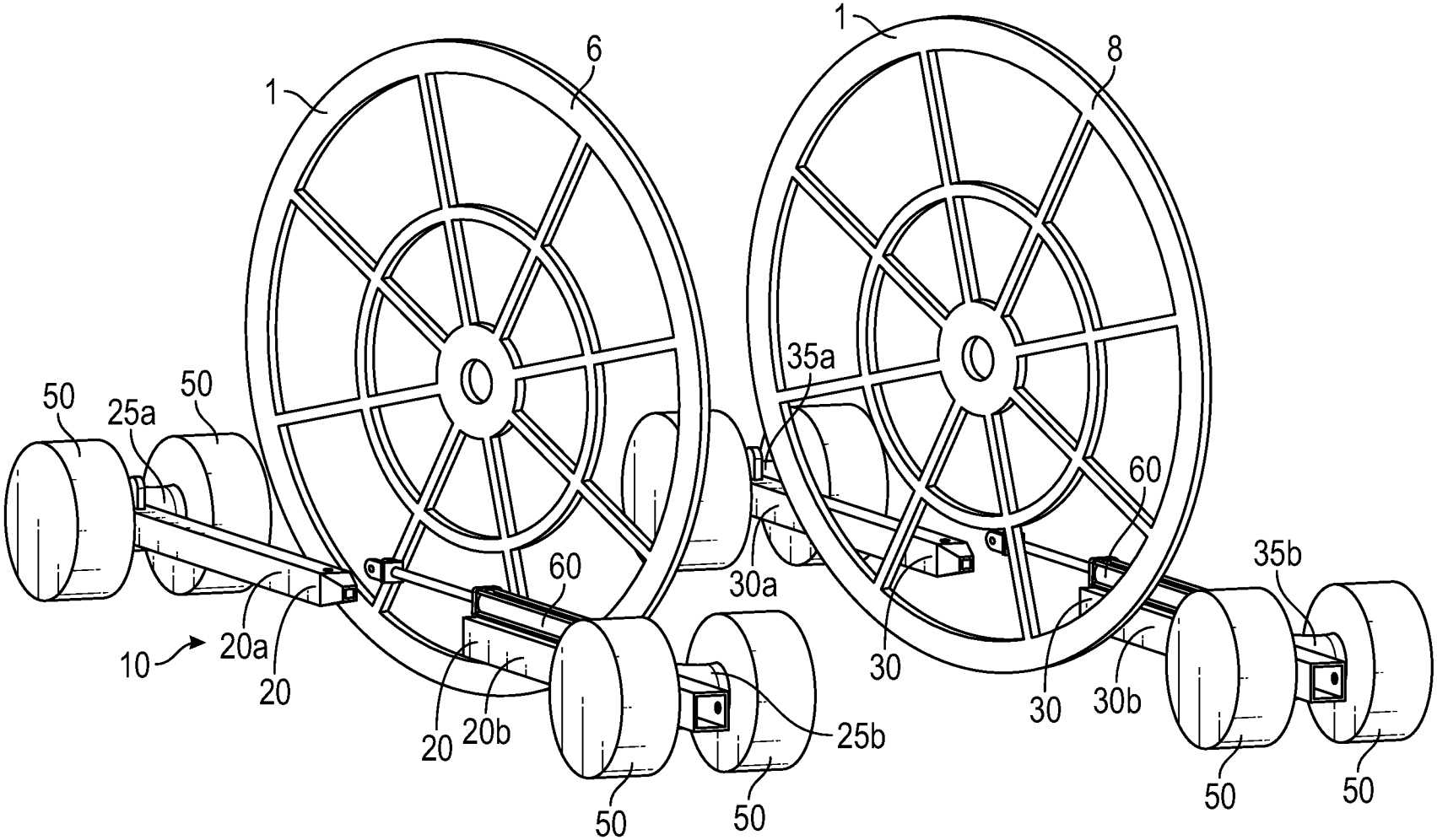
FIG. 2 is an exploded view of a mobile cradle frame for a reel of pipe according to embodiments of the present disclosure.

FIG. 2 shows apparatus 10 in two parts or halves, and without the drum or coil of pipe 2 of reel 1 shown, to allow for full view of apparatus 10. During assembly, each side or half of the apparatus 10 can be set outside of the flange ends 6 and 8 of reel 1 as shown. The nested tubing of male segment 20*a*, 30*a* and female segment 20*b*, 30*b* can be aligned to join the assembly 10 together. The nested tubing can be square-shaped, circular-shaped, polygonal-shaped or various other shapes, in certain illustrative embodiments.

In certain illustrative embodiments, the first set of pipe reel engagement spools 25*a*, 25*b* and the second set of pipe reel engagement spools 35*a*, 35*b* are capable of contacting a first flange and a second flange, respectively, of the pipe reel, for example, reel ends 6 and 8.

Figure 2A:
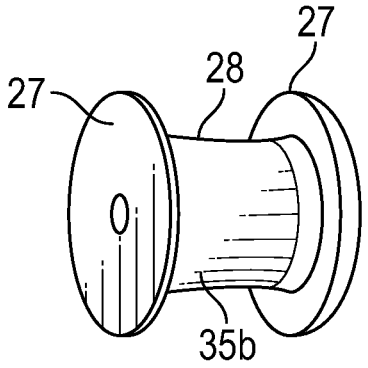
FIG. 2A is an enlarged view of a pipe reel engagement spool from FIG. 2, and having a pair of retaining walls with a channel formed therebetween for use on a mobile cradle frame for a reel of pipe according to embodiments of the present disclosure.

In certain illustrative embodiments, each pipe reel engagement spool 25*a*, 25*b*, 35*a*, 35*b* can include a pair of retaining walls 27 and a channel 28 formed therebetween for engaging the flange of the pipe reel (see FIG. 2A). This allows reel 1 to remain relatively stable while it is raised/lifted due to telescopic movement of the male (20*a*, 30*a*) and female (20*b*, 30*b*) segments.

Figure 2B:
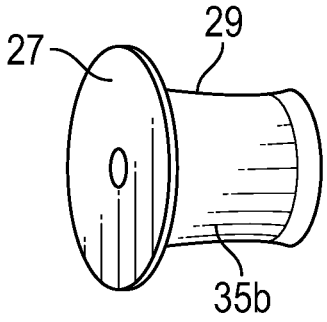
FIG. 2B is an enlarged view of a pipe reel engagement spool from FIG. 2, and having a single retaining wall and a base for use on a mobile cradle frame for a reel of pipe according to embodiments of the present disclosure.

Preferably, the pipe reel engagement spools 25*a*, 25*b*, 35*a*, 35*b* used for lifting will allow the first flange 6 and the second flange 8 to rotate for deployment. The orientation of the channel will align with the direction that the flanges 6 and 8 are facing, so that the flanges 6 and 8 sit within the channel 28. The amount of clearance for reel 1 depends on the size of the tires, flanges, and pipe. In certain illustrative embodiments, the channel 28 can be concave in shape and capable of retaining the flanges 6 and 8 between the retaining walls 27. In other illustrative embodiments, the channel 28 can have a rectangular or square shape that is capable of retaining the flanges 6 and 8 between the retaining walls 27, or alternatively, each pipe reel engagement spool 25*a*, 25*b*, 35*a*, 35*b* can include a single retaining wall 27 and a base 29 next to the retaining wall 27 that the flange of the pipe reel sits upon securely. (See FIG. 2B).

Figure 3A:
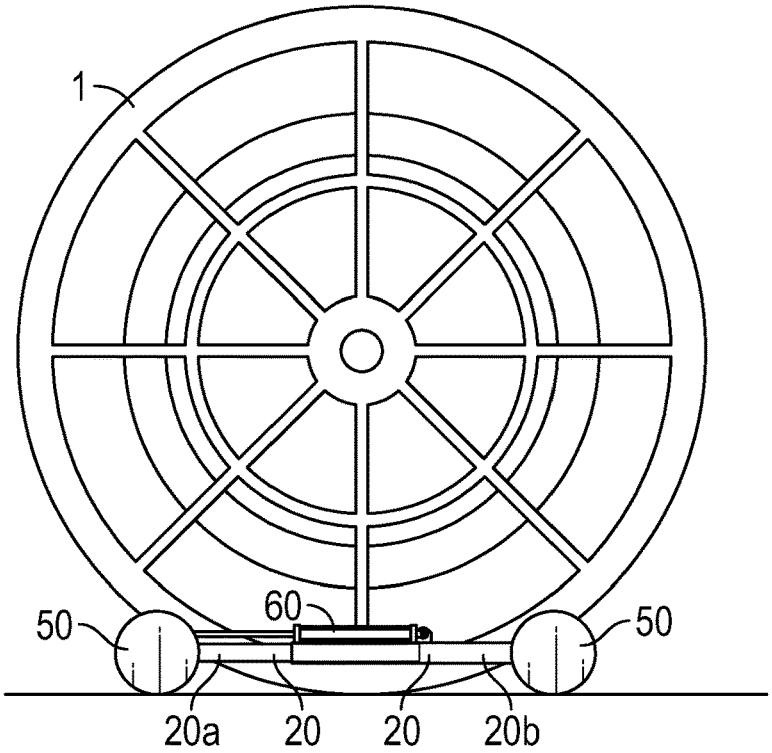
FIG. 3A is a side view of a mobile cradle frame for a reel of pipe with the actuator in an extended position according to embodiments of the present disclosure.
Figure 3B:
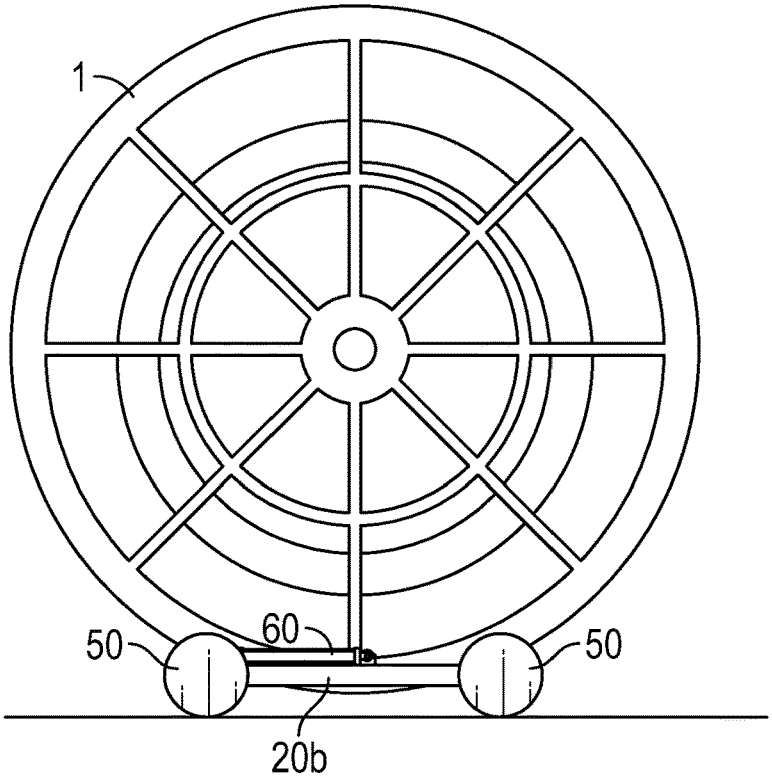
FIG. 3B is a side view of a mobile cradle frame for a reel of pipe with the actuator in a retracted position according to embodiments of the present disclosure.

In certain illustrative embodiments, as shown in FIG. 2, FIG. 3A and FIG. 3B, apparatus 10 can include a first actuator 60 connected to the male segment 20*a* and the female segment 20*b* of the first arm member 20 to promote telescopic movement between the segments 20*a*, 20*b*, and also a second actuator 60 connected to the male segment 30*a* and the female segment 30*b* of the second arm member 30 to promote telescopic movement between the segments 30*a*, 30*b*. Actuator 60 can be, for example, a hydraulically operated cylinder device. In other embodiments, actuator 60 can have, for example, electric or mechanical (e.g., rack and pinion) functionality. The first actuator 60 and the second actuator 60 can be actuated simultaneously, sequentially, or have staggered movement. Also, in certain illustrative embodiments, apparatus 10 can include a single actuator 60 that is connected to only the male segment and the female segment of the first arm member 20, or to only the male segment and the female segment of the second arm member 30, to promote telescopic movement between the segments, such that the single actuator 60 powers telescopic movement for both first arm member 20 and second arm member 30.

Figure 2C:
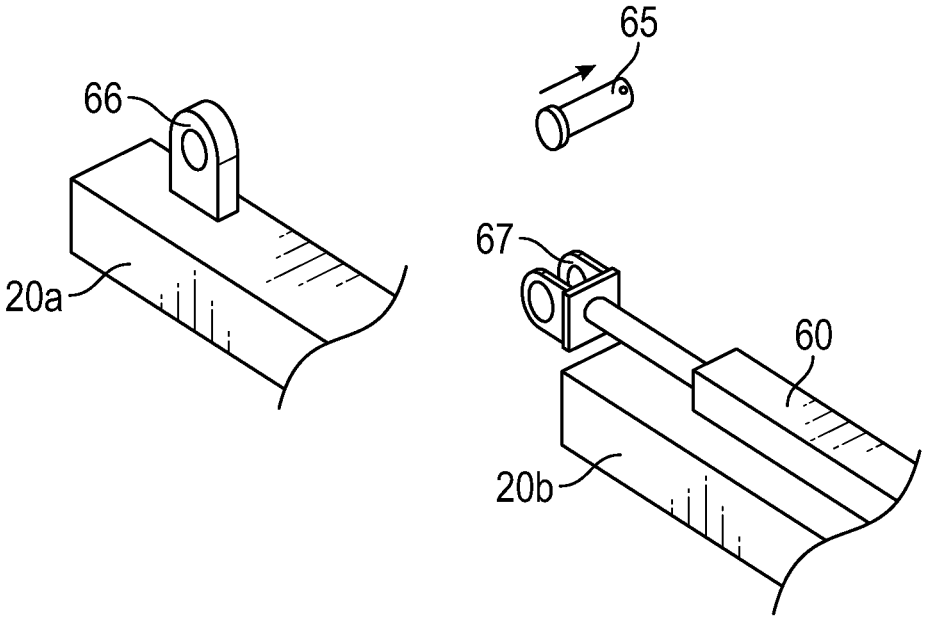
FIG. 2C is an enlarged view of a pin from FIG. 2, wherein the pin connects an actuator on a male segment and a female segment of a mobile cradle frame for a reel of pipe according to embodiments of the present disclosure.

In certain illustrative embodiments, one or more pins 65 (see FIG. 2C) can be used to connect the actuator 60 on male segment 20*a*, 30*a* to female segment 20*b*, 30*b*, or vice versa, by connecting a pad-eye 66 and a yoke 67. Pins 65 can be sized such that they provide sufficient strength to hold pad-eye 66 and yolk 67 securely together, and can be, for example, cylindrically shaped pins, or cotter pins, etc.

In other illustrative embodiments, the actuator could be located inside of, instead of outside of, the male segment 20*a*, 30*a* and/or female segment 20*b*, 30*b*.

FIG. 3A shows the actuator 60 in an expanded position, and FIG. 3B shows the actuator 60 in a retracted position. In certain illustrative embodiments, the first set of pipe reel engagement spools 25*a*, 25*b* and the second set of pipe reel engagement spools 35*a*, 35*b* can rotate to raise/lift the first flange and the second flange thereonto when the pipe reel is positioned between the first arm member 20 and the second arm member 30 and the proximal end and the distal end of the first arm member 20 and the second arm member 30 are brought closer together due to telescopic movement of the male 20*a*, 30*a* and female 20*b*, 30*b* segments, that is, movement of actuator 60 from the expanded position of FIG. 3A to the retracted position of FIG. 3B.

Figure 4A:
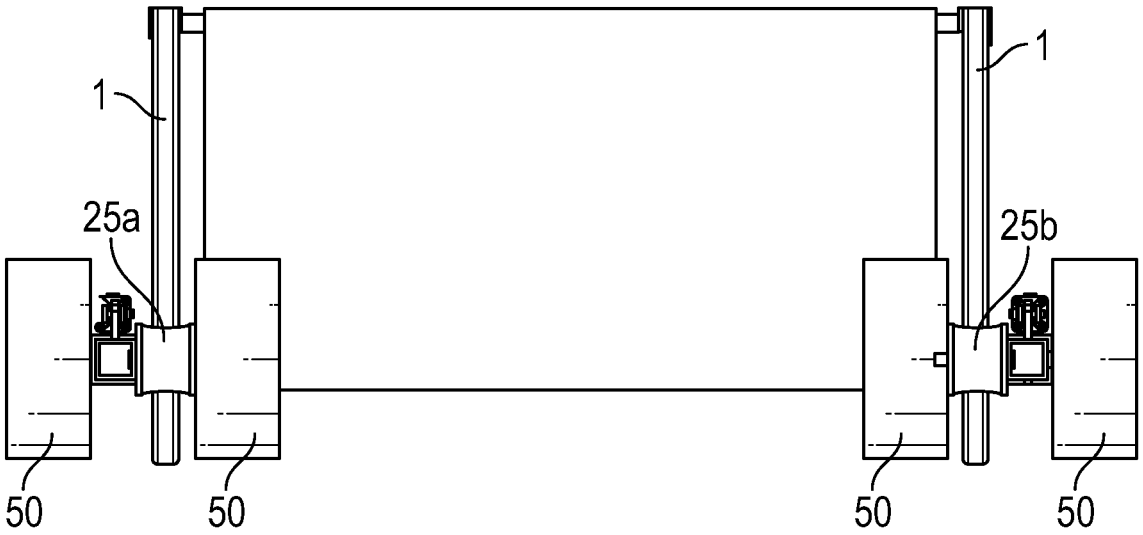
FIG. 4A is a rear view of a mobile cradle frame for a reel of pipe with the actuator in an extended position according to embodiments of the present disclosure.
Figure 4B:
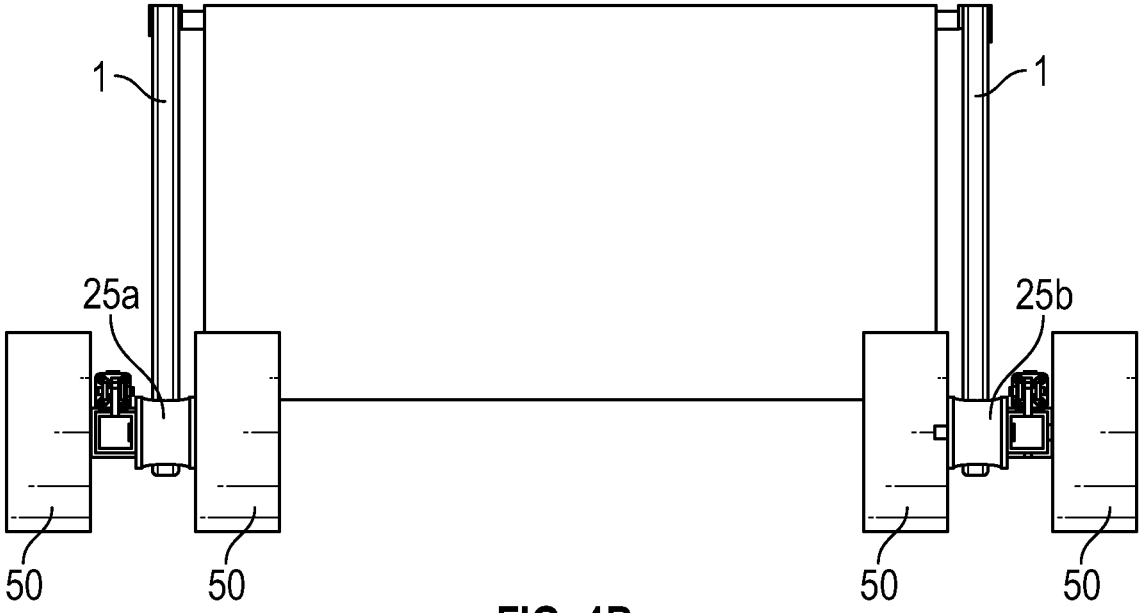
FIG. 4B is a rear view of a mobile cradle frame for a reel of pipe with the actuator in a retracted position according to embodiments of the present disclosure.
Figure 5B:
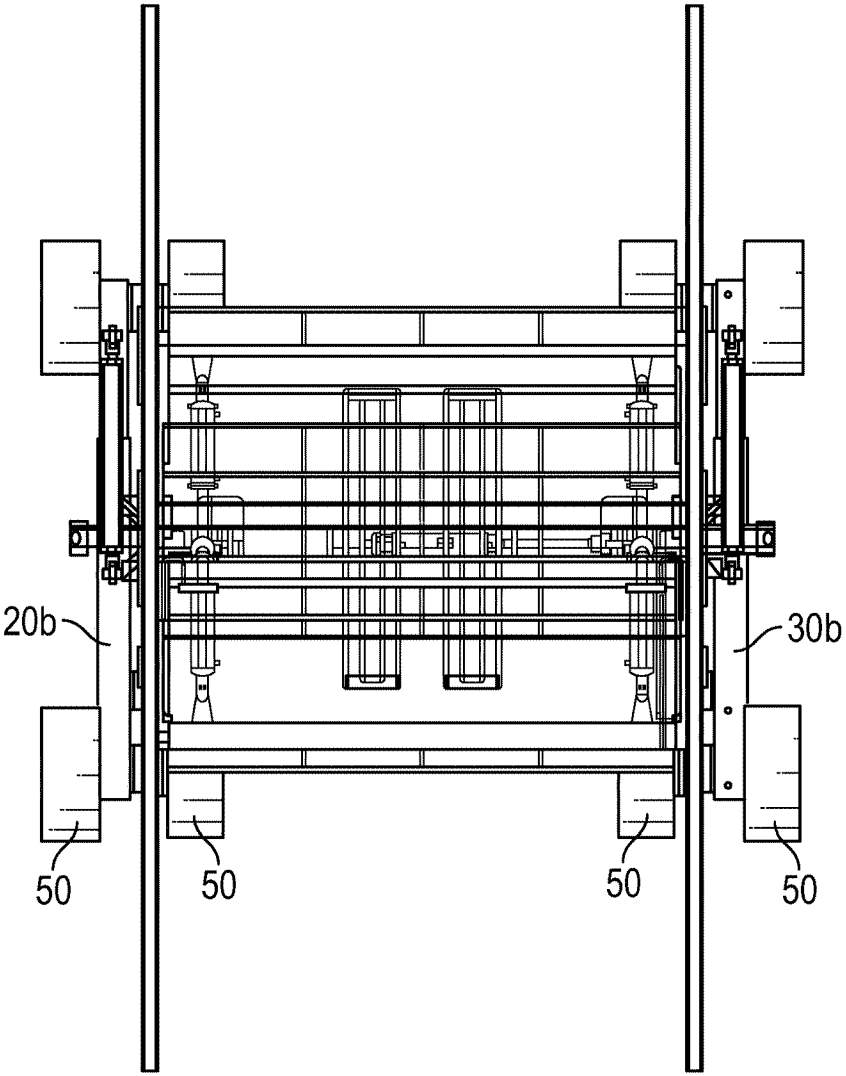
FIG. 5B is a top view of a mobile cradle frame for a reel of pipe with the actuator in a retracted position according to embodiments of the present disclosure.
Figure 5A:
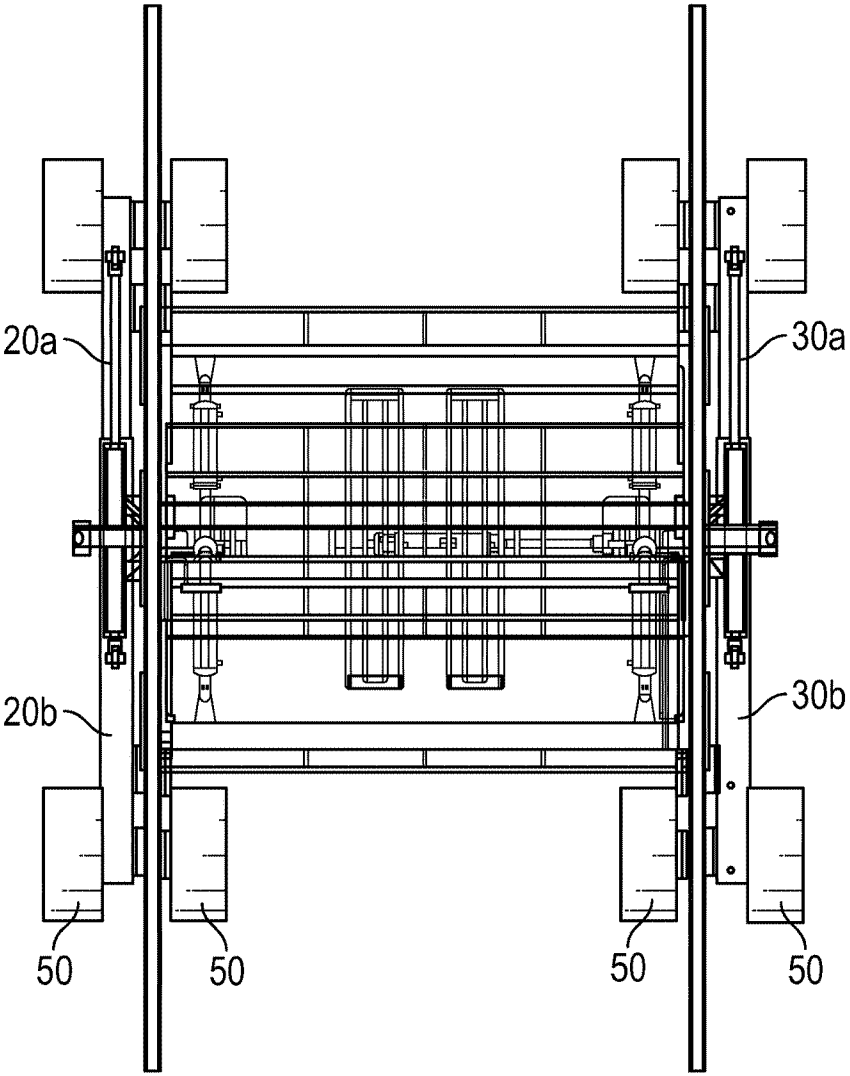
FIG. 5A is a top view of a mobile cradle frame for a reel of pipe with the actuator in an extended position according to embodiments of the present disclosure.

FIG. 4A is a rear view, and FIG. 5A is a top view, of apparatus 10 with the actuator 60 in an extended position, akin to what is shown in FIG. 3A. In this position, reel 1 is in a lowered position on apparatus 10. By comparison, FIG. 4B is a rear view, and FIG. 5B is a top view, of apparatus 10 with the actuator 60 in a retracted position, akin to what is shown in FIG. 3B. In this position of FIGS. 3B, 4B and 5B, reel 1 is in a raised position on apparatus 10, and is capable of being transported along the ground surface while sitting upon apparatus 10.

Figure 6:
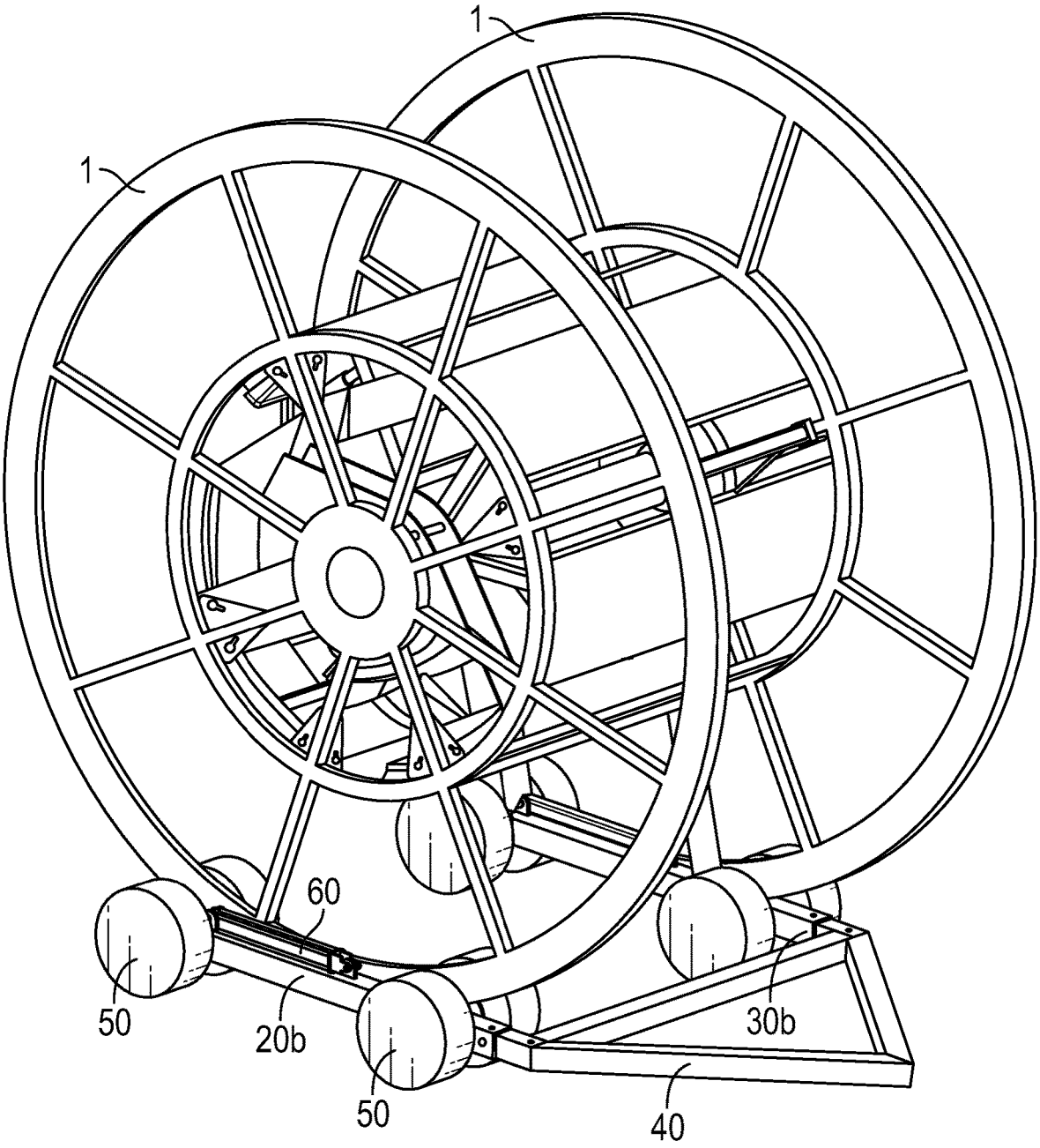
FIG. 6 is a perspective view of a mobile cradle frame for a reel of pipe with a connection member disposed thereon according to embodiments of the present disclosure.

In certain illustrative embodiments, as shown in FIG. 6, a connecting member 40 can be coupled to first arm member 20 and second arm member 30 and extend therebetween. Connecting member 40 can be used, for example, as a tow bar to pull apparatus 10 with a truck or other pulling means from location to location in the field for deployment. Connecting member 40 can also be used as an anchor point during deployment.

In certain illustrative embodiments, apparatus 10 can include a plurality of roller wheels 50 coupled to the first arm member 20, the second arm member 30 and/or the connecting member 40 and capable of engaging a ground surface, to allow for easy rolling movement of apparatus 10. Preferably, the roller wheels 50 do not clash with the pipe 12 or flanges ends 6 and 8 of reel 1. In certain illustrative embodiments, a track mechanism (not shown) similar to that on a tank can be utilized instead of roller wheels 50 to facilitate movement of apparatus 10.

Figure 7:
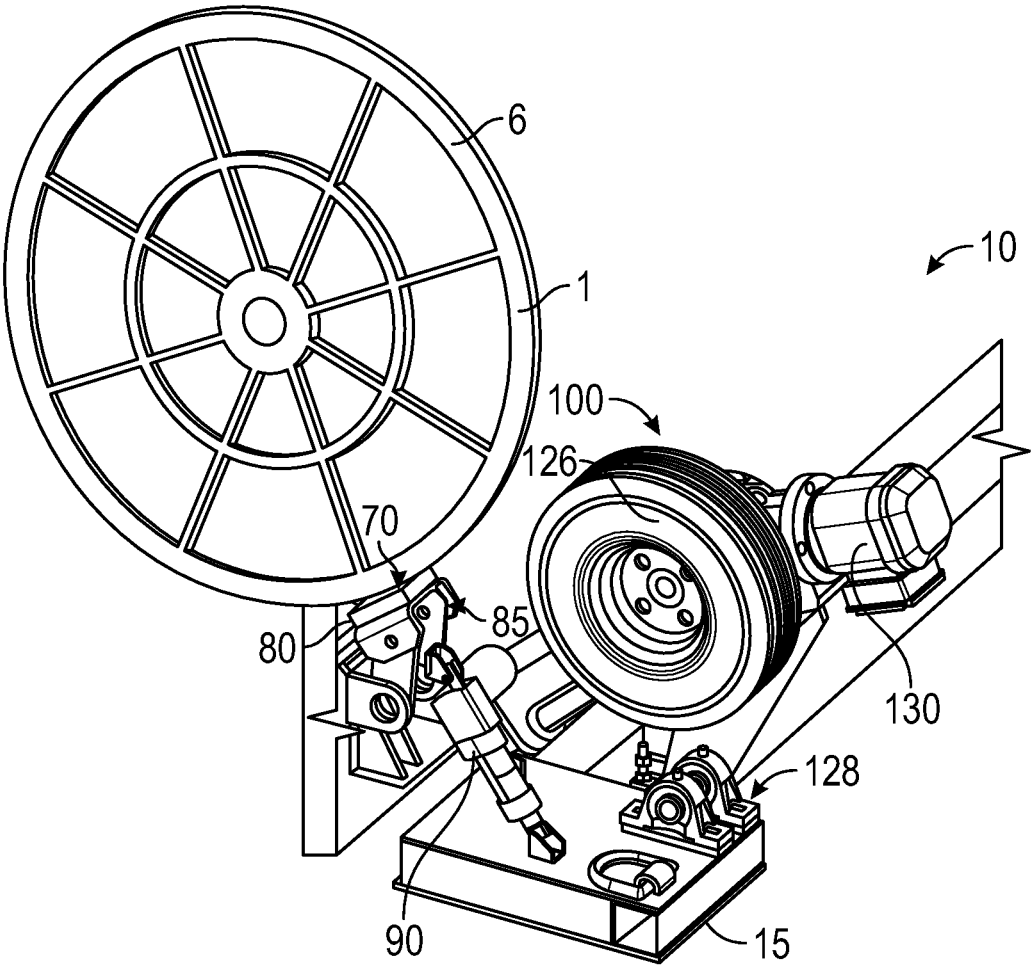
FIG. 7 is a perspective view of a mobile cradle frame for a reel of pipe having a braking mechanism and pipe re-spooler disposed thereon according to embodiments of the present disclosure.

In certain illustrative embodiments, braking and motor systems can also be added, as well as safety chain restraints to hold the equipment in place. For example, a brake 70 may be coupled to apparatus 10 and used to slow or stop rotation of reel 1. FIG. 7 illustrates a perspective view of the brake 70 of an illustrative embodiment of apparatus 10. Brake 70 is coupled to a frame 15 of apparatus 10. Frame 15 can include, for example, first arm member 20 and second arm member 30, and any connecting or associated components. In various illustrative embodiments, different numbers of brakes 70 may be used, such as one, two, three or four brakes 70, and the brakes 70 may be disposed at other locations. As shown in FIG. 7, brake 70 includes a brake pad 80 coupled to a brake bracket 85 and a brake actuator 90. When braking (e.g., slowing or stopping) of reel 1 is desired, brake 70 may be actuated to bring brake pad 80 in contact with a flange arm 6, 8 of reel 1. Friction between brake pad 80 and with flange arm 6, 8 of reel 1 then slows or stops rotation of reel 1. Brake pad 80 may be made from various materials, such as, but not limited to, non-metallic materials, semi-metallic materials, fully metallic materials, or ceramic materials. Brake pad 80 may be detachably coupled to brake bracket 85 to be easily replaced when worn. Brake actuator 90 may be an electric or hydraulic actuator or motor to enable movement of brake pad 80 toward or away from reel 1. Brake actuator 90 also enables adjustment of the braking force against reel 1. Brake bracket 85 may take different forms, but serves to support brake pad 80 and brake actuator 90. In further embodiments, brake 70 may be configured as a caliper brake with one or more calipers to engage the roller wheels 50. In either case, brake 50 can be configured to engage a peripheral circumferential surface of flange arm 6, 8 of reel 1 to stop or slow rotational movement thereof.

In certain illustrative embodiments, as shown in FIG. 7, a pipe re-spooler 100 can also be associated with apparatus 10. Pipe re-spooler 100 can include a wheel 126 coupled to a re-spooler bracket 128 that is then coupled to a re-spooler actuator 130. In various embodiments, different numbers of pipe re-spoolers 100 may be used, such as 1, 2, 3, or 4 pipe re-spoolers 100, and the pipe re-spoolers 100 may be disposed at various locations on or near apparatus 10. When re-spooling (e.g., placing a coil of pipe 2 that has been deployed back on the reel 1) is desired, the re-spooler actuator 130 may be actuated to cause the wheel 126 to rotate in an opposite direction from the desired direction of the reel 1. In certain illustrative embodiments, the re-spooler actuator 130 may also be used to bring the wheel 126 in contact with the flange ends 6 and 8 of reel 1. Alternatively, the wheel 126 may be left in contact with the flange ends 6 and 8 when not re-spooling, thereby allowing the wheel 126 to free spin (e.g., the re-spooler actuator 130 is not actuated). The re-spooler actuator 130 may also be used to adjust the speed of re-spooling (e.g., rotational speed of the reel 1).

The wheel 126 of the pipe re-spooler 100 may be made from various materials, such as, but not limited to, rubber, plastic, or metal. The material for the wheel 126 may be selected to provide sufficient friction or grip to be able to cause the reel 1 to rotate when the wheel 126 is rotated. In addition, the wheel 126 may have a flexible or compliant surface to accommodate variations in roundness of the flange ends 6 and 8 and to provide additional contact surface area when the wheel 126 is pushed against the flange ends 6 and 8. In one embodiment, the wheel 126 may be a pneumatic vehicle tire. In addition, the wheel 126 may be detachably coupled to the re-spooler bracket 128 to be easily replaced when worn. The re-spooler actuator 130 may be an electric or hydraulic actuator or motor to enable movement of the wheel 126 toward or away from the flange ends 6 and 8. The re-spooler bracket 128 may take different forms, but serves to support the wheel 126 and the re-spooler actuator 130. For example, the re-spooler bracket 128 may be coupled to the frame 15. In certain embodiments, the pipe re-spooler 100 may be adjustable axially to accommodate reels 1 of different reel widths.

Figure 8:
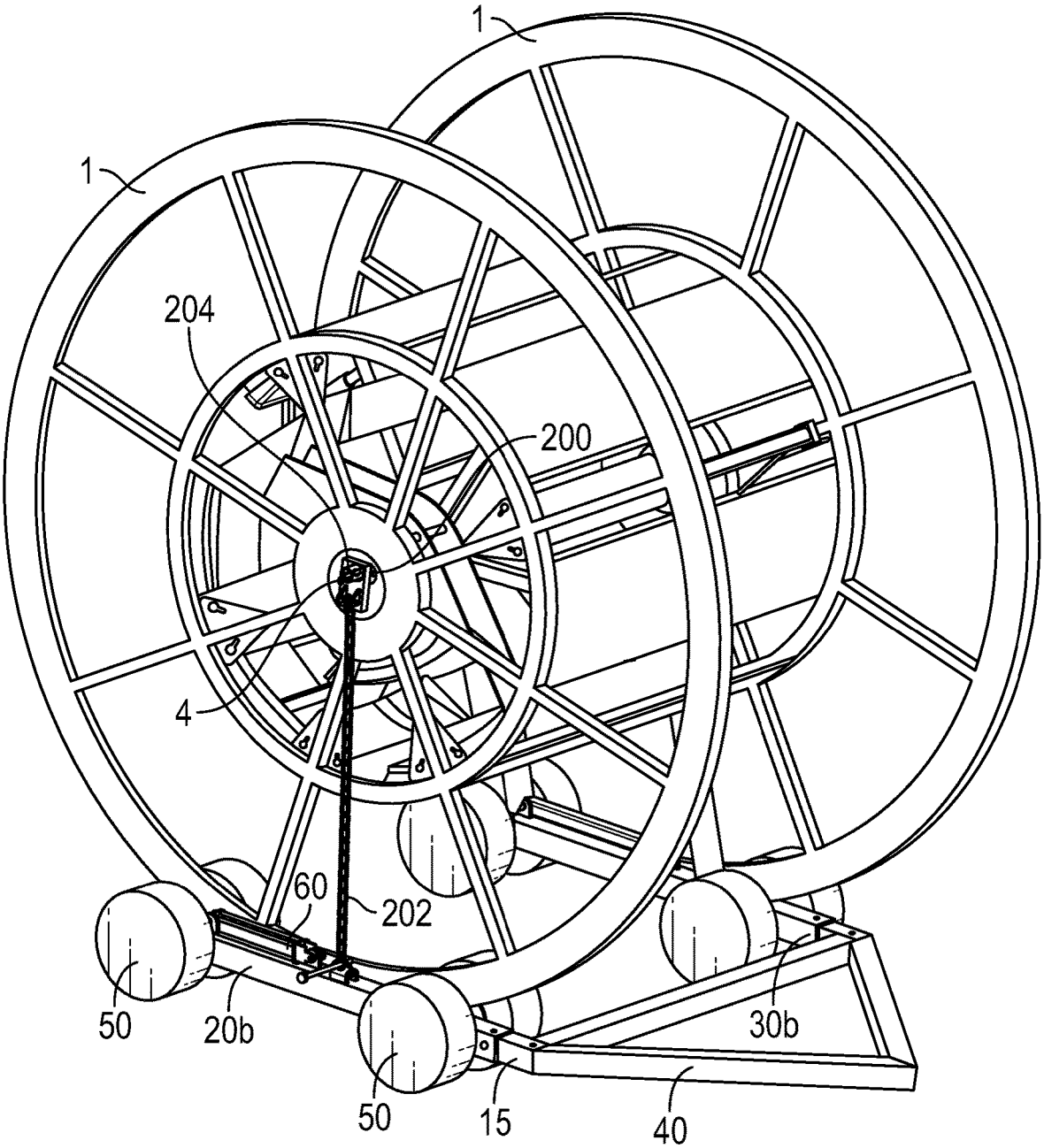
FIG. 8 is a perspective view of a mobile cradle frame for a reel of pipe with a chain restraint disposed thereon according to embodiments of the present disclosure.

FIG. 8 illustrates a perspective view of an embodiment of apparatus 10 with a retention shaft 200 and chain restraint 202. During deployment, the tension on the pipe 12 may try to lift and roll the reel 1 up and off of the mobile apparatus 10. As shown in FIG. 8, retention shaft 200 may be used to secure reel 1 to apparatus 10, in certain illustrative embodiments. Retention shaft 200 may be a cylindrical rod or shaft that is inserted into bore 4 of reel 1. In certain embodiments, the retention shaft 200 may include bearings or similar devices to enable the reel 1 to easily rotate about the retention shaft 200. A chain 202 may be coupled to one end of the retention shaft 200 and to the nested tubing of male segment 20*a*, 30*a*, and/or female segment 20*b*, 30*b*, or similar attachment points on frame 15. Frame 15 can include, for example, first arm member 20 and second arm member 30, and any connecting or associated components. A cotter pin 204 or similar device may be used to secure the chain 202 to the retention shaft 200. In certain embodiments, a come-a-long or similar device may be used to tighten the chain 202. In further embodiments, other devices may be used for the chain 202, such as wire or rope. Although only one side of the reel 1 is shown in FIG. 8, the retention shaft 200 may be secured in a similar manner as described on both sides of the reel 1. In some embodiments, more than one chain 202 may be used on a side of the reel 1, such as two, three, or more chains 202. In these embodiments, the chains 202 may be secured to the same location of the frame 15, or to different locations. For example, if two chains 202 are used, they may be arranged like an inverted letter V with the tip at the bore 4 of reel 1 and the legs representing the two chains 202.

Figure 9:
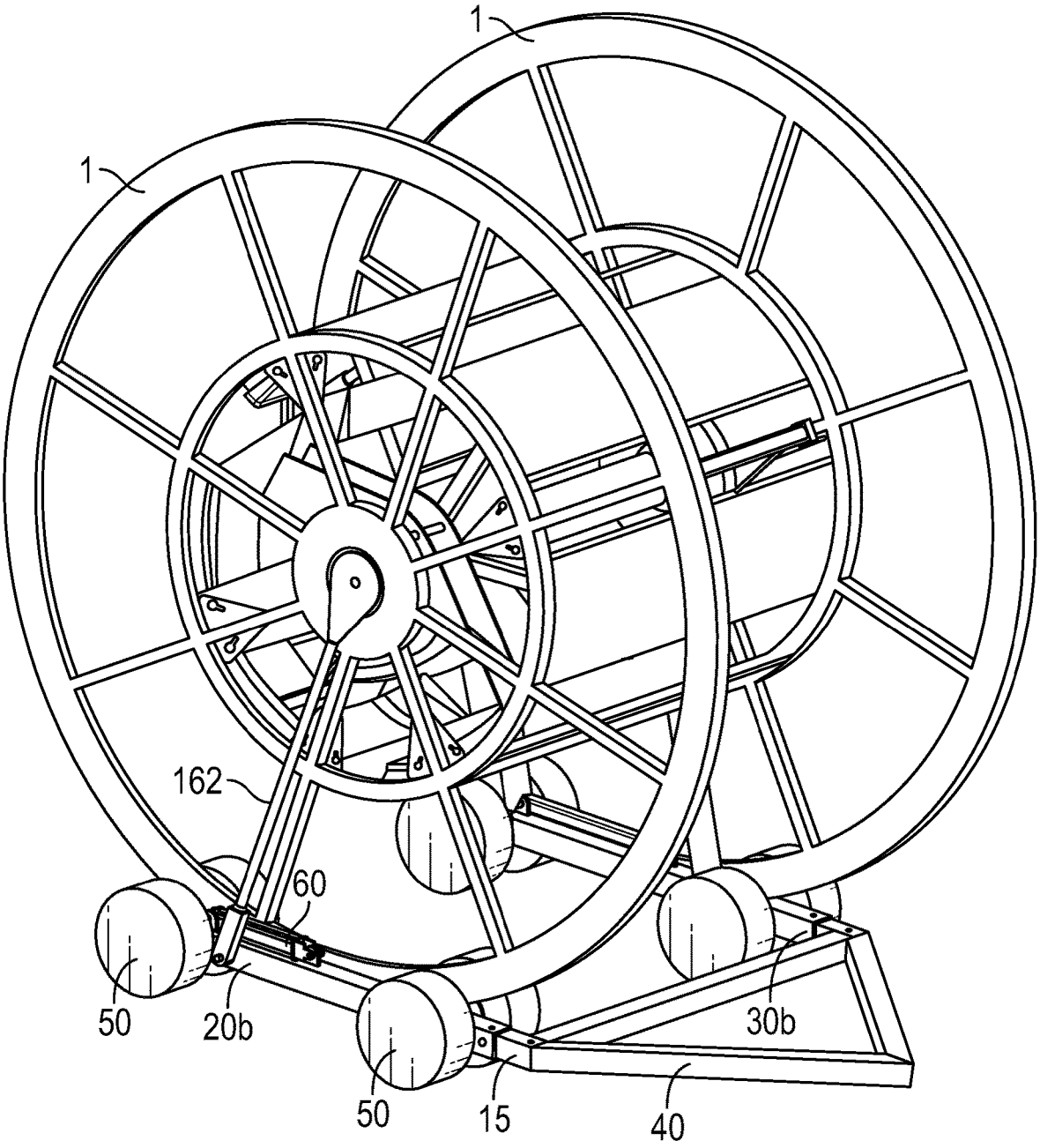
FIG. 9 is a perspective view of a mobile cradle frame for a reel of pipe with a pipe tension arm disposed thereon according to embodiments of the present disclosure.

FIG. 9 illustrates a side perspective view of an embodiment of the reel 1 and apparatus 10 with a pipe tension arm 162. Although only one pipe tension arm 162 is shown in FIG. 9, a second pipe tension arm 162 may be used on the opposite side of the reel 1 and apparatus 10 in certain embodiments. As shown in FIG. 9, the pipe tension arm 162 has a first end that removably couples to the frame 15 and a second end that removably couples to the bore 4 of the reel 1. The pipe tension arm 162 may help maintain contact of the reel 1 against the pipe re-spooler 100 (shown in FIG. 7). For example, the combined weight of the reel 1 and spoolable pipe 2 decreases as the spoolable pipe 2 is deployed, which may cause the reel 1 to lose contact with the pipe re-spooler 100. Thus, the pipe tension arm 162 may counteract any movement of the reel 1 away from the pipe re-spooler 100 by providing a fixed distance between the bore 4 and the frame 15. In certain embodiments, the frame 15 may include a plurality of arm holes located at different locations for the first end to be inserted into. Thus, the plurality of arm holes enables pipe tension arms 162 with a fixed length to be used with reels 1 of different reel diameters.

Examples of various components and features that can be utilized in accordance with apparatus 10 described herein are shown in U.S. Pat. No. 10,301,149 issued on May 28, 2019, and assigned to Trinity Bay Equipment Holdings LLC, the contents of which are incorporated by reference herein in their entirety.

Various methods of supporting a reel 1 of pipe are also disclosed herein. For example, in certain illustrative embodiments, a reel 1 of pipe can be placed within cradle apparatus 10. Apparatus 10 can include first arm member 20 and second arm member 30, the arm members 20, 30 each having male segment 20*a*, 30*a* and female segment 20*b*, 30*b* capable of telescopic movement.

Apparatus 10 can also include first set of pipe reel engagement spools 25*a*, 25*b* disposed at a proximal end and a distal end of first arm member 20 and capable of rotational movement with respect to first arm member 20, and second set of pipe reel engagement spools 35*a*, 35*b* disposed at a proximal end and a distal end of second arm member 30 and capable of rotational movement with respect to second arm member 30. Each pipe reel engagement spool 25*a*, 25*b*, 35*a*, 35*b* can include a pair of retaining walls and a concave-shaped channel formed therebetween for engaging a flange of the pipe reel.

In certain illustrative embodiments, the proximal end and the distal end of first arm member 20 can be moved closer together via telescopic movement of the respective male 20*a* and female 20*b* segments, such that the first set of pipe reel engagement spools 25*a*, 25*b* contact the first flange of the pipe reel. Rotational movement of the first set of pipe reel engagement spools 25*a*, 25*b* causes the first flange to be raised by and sit upon the first set of pipe reel engagement spools 25*a*, 25*b*. Also, the proximal end and the distal end of the second arm member 30 are moved closer together via telescopic movement of the respective male 30*a* and female 30*b* segments, such that the second set of pipe reel engagement spools 35*a*, 35*b* contact a second flange of the pipe reel and rotational movement of the second set of pipe reel engagement spools 35*a*, 35*b* causes the second flange to be raised by and sit upon the second set of pipe reel engagement spools 35*a*, 35*b*. Once movement of the proximal end and the distal end of the first arm member 20 closer together, and of the proximal end and the distal end of the second arm member 30 closer together, are ceased, the reel 1 of pipe will be supported in a raised position.

The presently disclosed apparatus and related methods have a number of advantages over prior art devices. For example, the apparatus is capable of lifting the flanges and coil, moving the coil to a desired deployment location, and allowing deployment by pulling on the pipe or holding the pipe and pulling the assembly down the right of way. Adding I-beams (sled/ski) or tires (dolly) to the core of the design provides the ability to move the pipe down the right-of-way from a staging location. The presently disclosed apparatus and related methods allow for handling, lifting, and deploying pipe, and the dolly/ski configuration allows for a compact, lighter weight deployment concept as well as quick disassembly for shipping and handling. Combining cradle frame design features into the dolly system allows for deployment by interfacing with the flanges on a reel for braking and containment.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. A cradle apparatus for supporting a pipe reel, the cradle apparatus comprising:

a first arm member and a second arm member each comprising a male segment and a female segment configured to move telescopically relative to one another;

a first set of pipe reel engagement spools disposed at a first proximal end and a first distal end of the first arm member, wherein:

each pipe reel engagement spool in the first set of pipe reel engagement spools comprises a first base configured to engage a first flange of the pipe reel and a single retaining wall that is connected to and extends out from the first base such that the single retaining wall rotates with the first base to facilitate retaining the first flange of the pipe reel on the first base; and each pipe reel engagement spool in the first set of pipe reel engagement spools is configured to:

rotate with respect to the first arm member; and raise the first flange of the pipe reel when the first proximal end and the first distal end of the first arm member are brought closer together via telescopic movement of the male segment and the female segment of the first arm member;

a second set of pipe reel engagement spools disposed at a second proximal end and a second distal end of the second arm member, wherein:

each pipe reel engagement spool in the second set of pipe reel engagement spools comprises a second base configured to engage a second flange of the pipe reel; and each pipe reel engagement spool in the second set of pipe reel engagement spools is configured to:

rotate with respect to the second arm member; and raise the second flange of the pipe reel when the second proximal end and the second distal end of the second arm member are brought closer together via telescopic movement of the male segment and the female segment of the second arm member;

a connecting member configured to be coupled to the first arm member and the second arm member; and a ground engagement device coupled to one or more of the first arm member, the second arm member, and the connecting member, wherein the ground engagement device is configured to engage a ground surface.

2. The cradle apparatus of claim 1, wherein each pipe reel engagement spool in the second set of pipe reel engagement spools comprises another single retaining wall that is connected to and extends out from the second base such that the other single retaining wall rotates with the second base to facilitate retaining the second flange of the pipe reel on the second base.

3. The cradle apparatus of claim 1, wherein the first base of each pipe reel engagement spool in the first set of pipe reel engagement spools is concave-shaped.

4. The cradle apparatus of claim 1, further comprising an actuator connected to the male segment and the female segment of the first arm member, wherein the actuator is configured to operate to move the male segment and the female segment of the first arm member telescopically relative to one another.

5. The cradle apparatus of claim 4, further comprising another actuator connected to the male segment and the female segment of the second arm member, wherein the other actuator is configured to operate to move the male segment and the female segment of the second arm member telescopically relative to one another.

6. The cradle apparatus of claim 1, wherein the single retaining wall of each pipe reel engagement spool in the first set of pipe reel engagement spools extends out from the first base such that the single retaining wall extends out perpendicular to a longitudinal axis of the first base.

7. The cradle apparatus of claim 1, wherein:

the male segment and the female segment of the first arm member are configured to move telescopically relative to one another at a first time; and the male segment and the female segment of the second arm member are configured to move telescopically relative to one another at a second time different from the first time.

8. The cradle apparatus of claim 1, wherein the single retaining wall of each pipe reel engagement spool in the first set of pipe reel engagement spools has a circular shape.

9. The cradle apparatus of claim 1, further comprising a brake coupled to the second arm member, wherein the brake is configured to selectively engage the second flange of the pipe reel to facilitate slowing or stopping rotation of the pipe reel.

10. The cradle apparatus of claim 9, wherein the brake comprises a brake pad configured to selectively engage a peripheral circumferential surface of the second flange of the pipe reel.

11. The cradle apparatus of claim 1, further comprising a pipe re-spooler coupled to the second arm member, wherein the pipe re-spooler comprises a wheel with a flexible surface configured to rotationally engage the second flange of the pipe reel to facilitate rotating the pipe reel.

12. The cradle apparatus of claim 1, further comprising:

a retention shaft configured to be inserted into a bore of the pipe reel; and a chain configured to be coupled to the retention shaft and a frame of the cradle apparatus to facilitate retaining the pipe reel on the cradle apparatus.

13. A method of supporting a pipe reel, the method comprising:

placing the pipe reel within a cradle apparatus, the cradle apparatus comprising:

a first arm member and a second arm member each having a male segment and a female segment that move telescopically relative to one another;

a connecting member to be coupled to the first arm member and the second arm member;

a ground engagement device coupled to one or more of the first arm member, the second arm member and the connecting member such that the ground engagement device engages a ground surface, a first set of pipe reel engagement spools disposed at a first proximal end and a first distal end of the first arm member, wherein:

each pipe reel engagement spool in the first set of pipe reel engagement spools rotates with respect to the first arm member; and each pipe reel engagement spool in the first set of pipe reel engagement spools comprise a first base that engages a first flange of the pipe reel and a single retaining wall that is connected to and extends out from the first base such that the single retaining wall rotates with the first base to facilitate retaining the first flange of the pipe reel on the first base; and a second set of pipe reel engagement spools disposed at a second proximal end and a second distal end of the second arm member, wherein:

each pipe reel engagement spool in the second set of pipe reel engagement spools rotates with respect to the second arm member; and each pipe reel engagement spool in the second set of pipe reel engagement spools comprises a second base that engages a second flange of the pipe reel;

moving the first proximal end and the first distal end of the first arm member closer together via telescopic movement of the male segment and the female segment of the first arm member such that the first set of pipe reel engagement spools contact the first flange of the pipe reel and rotational movement of the first set of pipe reel engagement spools causes the first flange to be raised by and sit upon the first set of pipe reel engagement spools;

moving the second proximal end and the second distal end of the second arm member closer together via telescopic movement of the male segment and the female segment of the second arm member such that the second set of pipe reel engagement spools contact the second flange of the pipe reel and rotational movement of the second set of pipe reel engagement spools causes the second flange to be raised by and sit upon the second set of pipe reel engagement spools; and ceasing telescopic movement of the male segment and the female segment of the first arm member and ceasing telescopic movement of the male segment and the female segment of the second arm to support the pipe reel in a raised position.

14. The method of claim 13, wherein each pipe reel engagement spool in the second set of pipe reel engagement spools comprises another single retaining wall that is connected to and extends out from the second base such that the other single retaining wall rotates with the second base to facilitate retaining the second flange of the pipe reel on the second base.

15. The method of claim 14, wherein the first base of each pipe reel engagement spool in the first set of pipe reel engagement spools is concave-shaped.

16. The method of claim 13, wherein moving the first proximal end and the first distal end of the first arm member closer together comprises operating an actuator connected to the male segment and the female segment of the first arm member to move the male segment and the female segment of the first arm member telescopically relative to one another.

17. The method of claim 16, wherein moving the second proximal end and the second distal end of the second arm member closer together comprises operating another actuator connected to the male segment and the female segment of the second arm member to move the male segment and the female segment of the second arm member telescopically relative to one another.

18. The method of claim 13, wherein the single retaining wall of each pipe reel engagement spool in the first set of pipe reel engagement spools extends out from the first base such that the single retaining wall extends out perpendicular to a longitudinal axis of the first base.

19. The method of claim 13, wherein:

moving the first proximal end and the first distal end of the first arm member closer together comprises telescopically moving the male segment and the female segment of the first arm member at a first time; and moving the second proximal end and the second distal end of the second arm member closer together comprises telescopically moving the male segment and the female segment of the second arm member at a second time different from the first time.

20. The method of claim 13, wherein the single retaining wall of each pipe reel engagement spool in the first set of pipe reel engagement spools extends out three hundred sixty degrees around the first base.

21. The method of claim 13, wherein the cradle apparatus comprises a brake coupled to the second arm member to enable the brake to selectively engage the second flange of the pipe reel to facilitate slowing or stopping rotation of the pipe reel.

22. The method of claim 21, wherein the brake comprises a brake pad configured to selectively engage a peripheral circumferential surface of the second flange of the pipe reel.

23. The method of claim 13, wherein the cradle apparatus comprises a pipe re-spooler coupled to the second arm member, wherein the pipe re-spooler comprises a wheel with a flexible surface configured to rotationally engage the second flange of the pipe reel to facilitate rotating the pipe reel.

24. The method of claim 13, comprising:

inserting a retention shaft into a bore of the pipe reel; and securing a chain to the retention shaft and to a frame of the cradle apparatus to facilitate retaining the pipe reel on the cradle apparatus.

* * * * *